US009212873B2

(12) United States Patent
Hartman et al.

(10) Patent No.: US 9,212,873 B2
(45) Date of Patent: Dec. 15, 2015

(54) SECOND CUT ARROW SHAFT EXTENSION

(71) Applicants: Christopher Michael Hartman, Royal Oak, MI (US); Ronald Mitchell Mcivor, Mount Pleasant, MI (US); John Edward Campbell, Hazel Park, MI (US)

(72) Inventors: Christopher Michael Hartman, Royal Oak, MI (US); Ronald Mitchell Mcivor, Mount Pleasant, MI (US); John Edward Campbell, Hazel Park, MI (US)

( * ) Notice: Subject to any disclaimer, the term of this patent is extended or adjusted under 35 U.S.C. 154(b) by 0 days.

(21) Appl. No.: 14/194,943

(22) Filed: Mar. 3, 2014

(65) Prior Publication Data

US 2014/0256482 A1 Sep. 11, 2014

Related U.S. Application Data

(60) Provisional application No. 61/775,438, filed on Mar. 8, 2013.

(51) Int. Cl.
*F42B 6/04* (2006.01)
*F42B 6/08* (2006.01)

(52) U.S. Cl.
CPC .... *F42B 6/04* (2013.01); *F42B 6/08* (2013.01)

(58) Field of Classification Search
CPC ..... F42B 6/04; F42B 6/08
See application file for complete search history.

(56) References Cited

U.S. PATENT DOCUMENTS

| | | | | |
|---|---|---|---|---|
| 2,725,656 | A | 12/1955 | Schmidt | |
| 3,168,313 | A | 2/1965 | Lint | |
| 3,738,657 | A | 6/1973 | Cox | |
| 4,579,348 | A * | 4/1986 | Jones | 473/583 |
| 4,940,246 | A * | 7/1990 | Stagg | 473/583 |
| 5,112,063 | A * | 5/1992 | Puckett | 473/583 |
| 5,472,213 | A | 12/1995 | Dudley | |
| 6,015,357 | A | 1/2000 | Rizza | |
| 6,270,435 | B1 | 8/2001 | Sodaro | |
| 7,713,151 | B2 | 5/2010 | Fulton | |
| 7,713,152 | B1 | 5/2010 | Tentler et al. | |
| 7,905,802 | B2 | 3/2011 | Erhard | |
| 8,414,432 | B1 * | 4/2013 | Hand | 473/583 |
| 2008/0102996 | A1 | 5/2008 | Erhard | |
| 2010/0004078 | A1 | 1/2010 | Flanagan | |
| 2010/0173734 | A1 | 7/2010 | Robbins | |

* cited by examiner

*Primary Examiner* — John Ricci
(74) *Attorney, Agent, or Firm* — Helmholdt Law PLC; Thomas D. Helmholdt

(57) ABSTRACT

A device for extending a shaft of an arrow including a hollow arrow sleeve having a forward end and a rearward end. The hollow arrow sleeve supporting at least one auxiliary, expandable, razor-sharp blade for pivoting movement between a stored position lying enclosed within the sleeve and a deployed position extending outwardly through a slot formed in the sleeve. The sleeve having at least one slot allowing passage of the at least one expandable razor-sharp blade from a stored position to a deployed position in response to movement of the at least one blade from the rearward position to the forward position relative to the sleeve. A member acting against the at least one auxiliary, expandable, razor-sharp blade for urging the blade toward the deployed position. A spring for biasing the member against the at least one auxiliary, expandable, razor-sharp blade.

20 Claims, 2 Drawing Sheets

SECOND CUT ARROW SHAFT EXTENSION

FIELD OF THE INVENTION

The invention relates to a projectile in the form of an elongated missile which is intended to be projected into the air for movement therethrough by a bow or crossbow, and in particular, having a shaft extending between a target-contacting head portion located at one end and feathering at an opposite end thereof, wherein a shaft extension supports auxiliary, expandable, razor-sharp blades adapted to cut a target.

BACKGROUND

Known arrow projectiles include a body, per se, constituting a missile which is intended to be propelled, launched, or otherwise projected by an archer who is hunting in an attempt to achieve the taking of an animal for trophy or food, the achievement of which requires some degree of skill on the part of the archer. The known arrow projectile can be in the form of an elongated missile which is intended to be projected into the air for movement therethrough by a bow or crossbow, and wherein the missile includes two or more of the following components: a target-contacting head portion, feathering or other flight guiding, stabilizing, or controlling means, or means for engaging the projecting portion of a projector used for projection of the missile.

Expandable arrow head blades are generally known from U.S. Pat. No. 7,905,802; U.S. Pat. No. 7,713,152; U.S. Pat. No. 7,713,151; U.S. Pat. No. 6,273,435; U.S. Pat. No. 6,015,357; U.S. Pat. No. 5,472,213; U.S. Pat. No. 3,738,657; U.S. Pat. No. 3,168,313; U.S. Pat. No. 2,725,656; U.S. Published Patent Application No. 2010/0173734; U.S. Published Patent Application No. 2010/0004078 and U.S. Published Patent Application No. 2008/0102996 to name just a few of many such examples. However, each of these known patents requires a special arrow head configuration. Some arrow heads will only fit on a particular manufacturer's arrow shaft requiring the additional purchase of a complementary arrow shaft to the arrow head desired. Each of these configurations is also limited to a front end of the arrow shaft, since the expandable blades are incorporated into the arrow head.

It would be desirable to provide expandable blades that can be used on any old arrow shaft or on any new arrow shaft. It would be desirable to extend the life of hunting arrows by providing a shaft extension, thereby allowing old arrow shafts to be cut back and still have enough length needed for use with the attachment of the shaft extension to the old cut back arrow shaft. It would be desirable to provide expandable blades that open without losing kinetic energy. It would be desirable to provide a shaft extension supporting expandable blades that can be placed anywhere along the length of the arrow shaft, i.e. front, middle, or back area. It would be desirable to provide a shaft extension supporting expandable blades for a better blood trail to track a wounded animal.

SUMMARY

A projectile can be defined by an elongated missile intended to be projected for movement through air by a bow, and can have a shaft extending between a target-contacting head portion located at one end and feathering at an opposite end thereof. A shaft extension body can be located between the target-contacting head portion and feathering of the shaft for supporting at least one auxiliary, expandable, razor-sharp blade adapted to cut a target.

A device can be provided for extending a shaft of an elongated arrow having a forward end and a rearward end. A shaft extension body can be located at any position along a length of the elongated arrow between the forward end and the rearward end inclusive for supporting at least one auxiliary, expandable, razor-sharp blade.

A device can be provided for extending a shaft of an arrow. The device can include a hollow arrow sleeve having a forward end and a rearward end. The hollow arrow sleeve can support at least one auxiliary, expandable, razor-sharp blade for pivoting movement between a stored position lying enclosed within the sleeve and a deployed position extending outwardly through a slot formed in the sleeve. A member can act against the at least one auxiliary, expandable, razor-sharp blade for urging the blade toward the deployed position.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
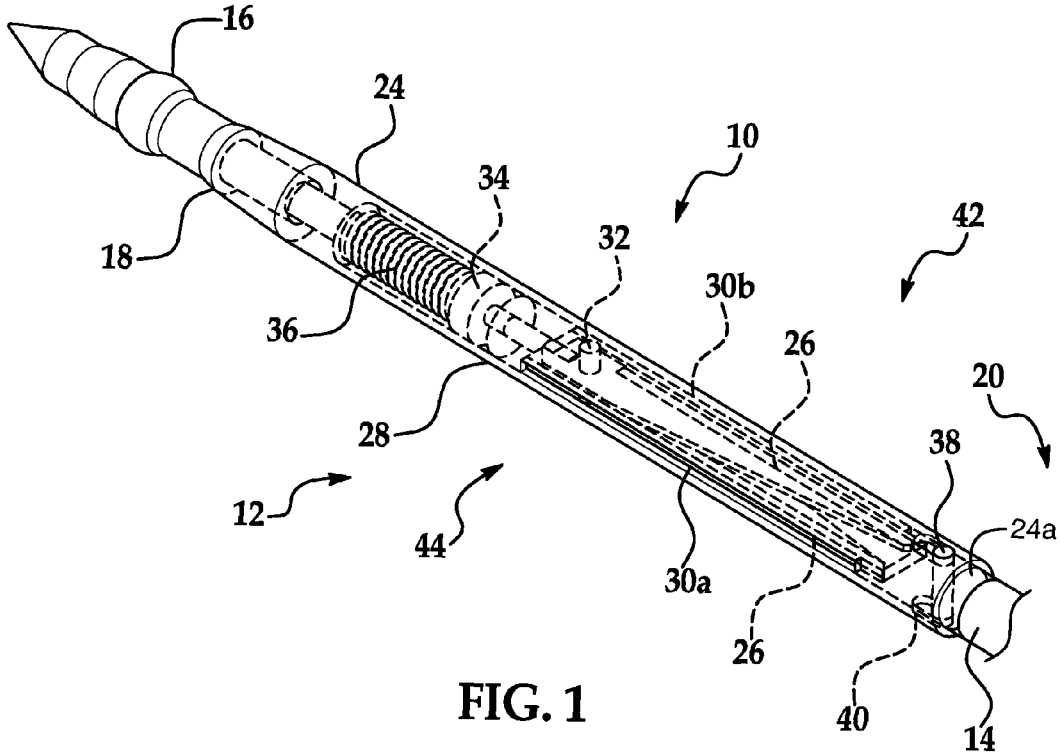
FIG. 1 is a perspective view of an arrow shaft extension having a sleeve enclosing expandable blades in a stored position, the sleeve having aligned slot openings allowing deployment of the expandable blades therethrough in response to impact of an arrow head with a target.
Figure 2:
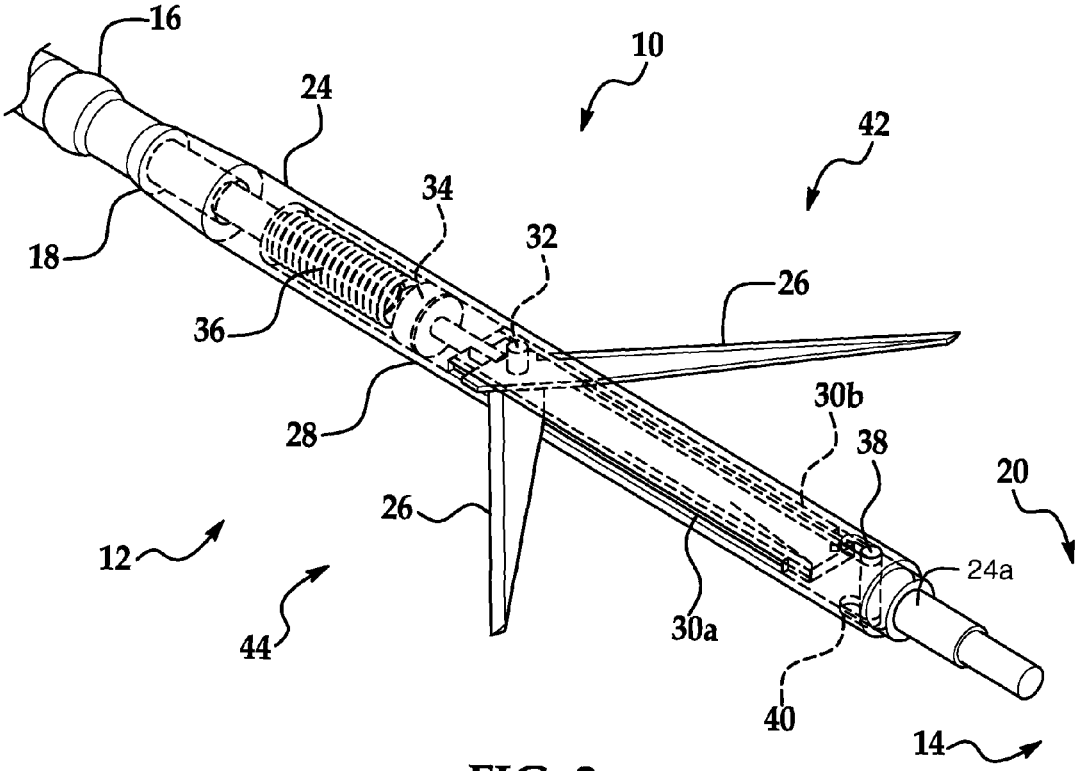
FIG. 2 is a perspective view of the arrow shaft extension of FIG. 1 with the expandable blades in a deployed position in response to impact of the arrow head with a target.
Figure 3:
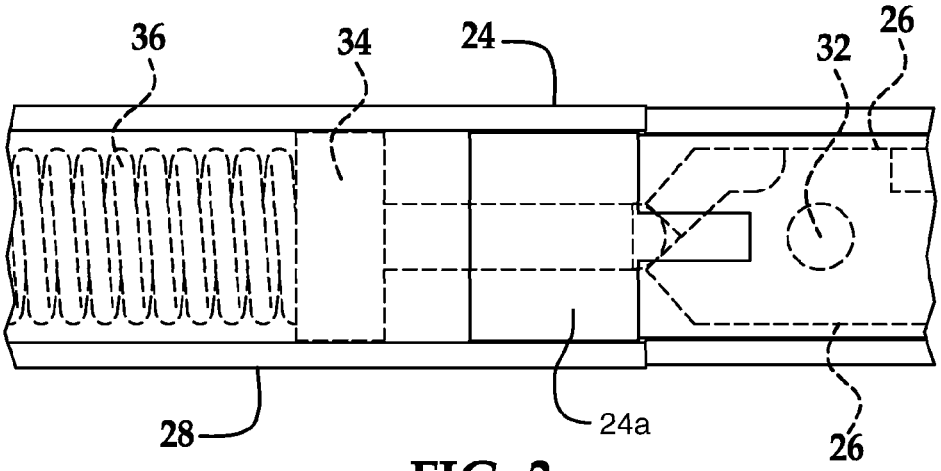
FIG. 3 is a detailed view of a pivot attachment of the expandable blades in the stored position and a spring biased member engaging ends of the expandable blades for urging the blades from the stored position toward the deployed position.
Figure 4:
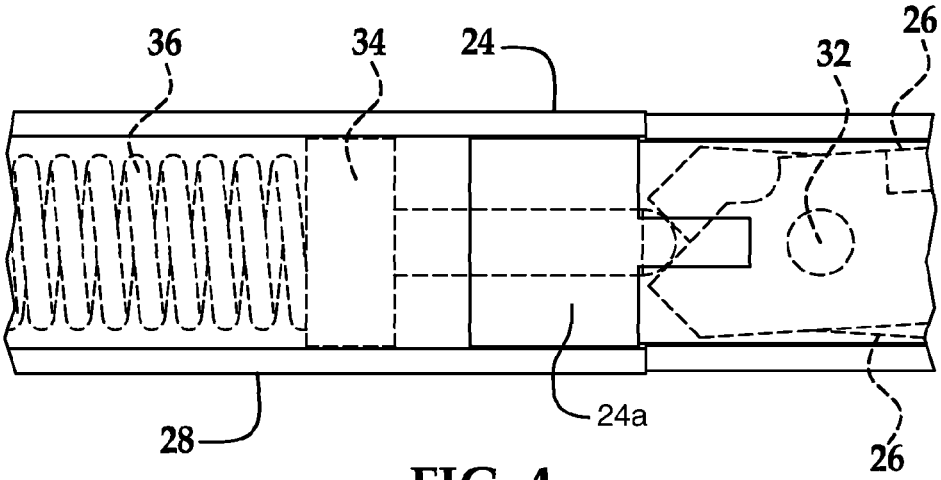
FIG. 4 is a detailed view of a pivot attachment of the expandable blades while moving from stored position toward the deployed position and a spring biased member engaging ends of the expandable blades for urging the blades from the stored position toward the deployed position.
Figure 5:
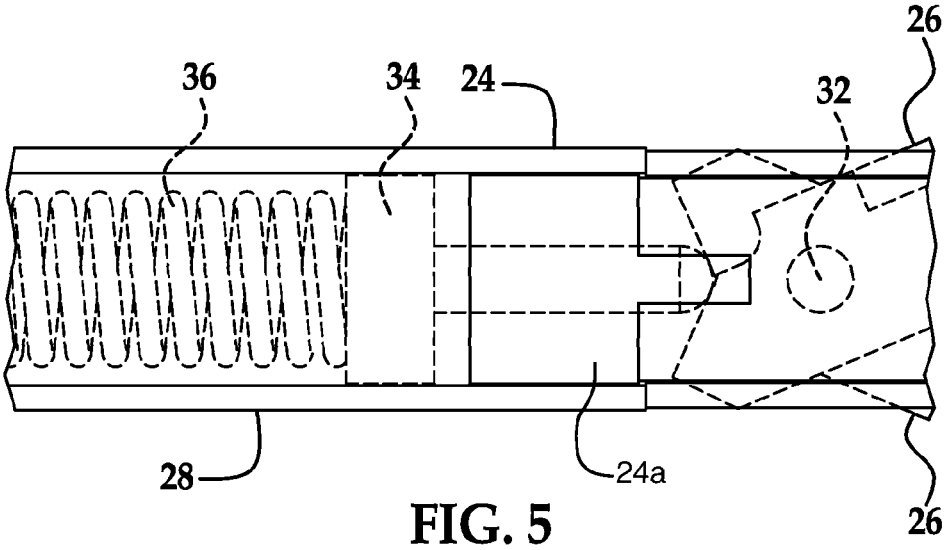
FIG. 5 is a detailed view of a pivot attachment of the expandable blades in the deployed position and a spring biased member engaging ends of the expandable blades for maintaining the blades in the deployed position.

Referring now to FIGS. 1-5, a projectile 10 is illustrated defined by an elongated missile 12 intended to be projected for movement through air by a bow, and having a shaft 14 extending between a target-contacting head portion 16 located at one end 18 and feathering at an opposite end 20 thereof. A shaft extension body 24 intended to be located between the target-contacting head portion 16 and feathering of the shaft 14 is shown for supporting at least one auxiliary, expandable, razor-sharp blade 26 adapted to cut a target. The shaft extension body 24 can include an elongated hollow sleeve 28 supported relative to the target-contacting head portion 16 allowing longitudinal movement of the at least one blade 26 between a rearward position and a forward position in response to the target-contacting head portion 16 impacting a target. The sleeve 28 can have at least one slot **30*a*, 30*b* allowing passage of the at least one expandable razor-sharp blade 26 from a stored position 44 to a deployed position 46 in response to movement of the at least one blade 26 from the rearward position to the forward position relative to the sleeve 28. A pin 32 can support the at least one expandable blade 26 with respect to the shaft 14 allowing pivoting movement of the at least one blade 26 between the stored position 44 and the deployed position 46. A member 34 can engage the at least one expandable blade 26 for urging the at least one blade 26 to pivot with respect to the pin 32 toward the deployed position 46. A spring 36 can be provided for biasing the member 34 toward the at least one expandable blade 26. A stop pin 38 can be supported relative to the shaft 14. The sleeve 28 can have a stop slot 40 formed therein to receive the stop pin 38 for controlling longitudinal movement of the shaft 14 with respect to the sleeve 28 in response to impact of the target-contacting head portion 16** with a target.

A device 10 can be provided for extending a shaft 14 of an elongated arrow 42 having a forward end 18 and a rearward end 20. A shaft extension body 24 can be located at any position along a length of the elongated arrow 42 between the forward end 18 and the rearward end 20 inclusive for supporting at least one auxiliary, expandable, razor-sharp blade 26. An elongated hollow sleeve 28 can be supported relative to the forward end 18 of the elongated arrow 42 allowing longitudinal movement of the at least one blade 26 between a rearward position and a forward position in response to the elongated arrow 42 impacting a target. The shaft extension body 24 can include at least one slot 30*a*, 30*b* allowing passage of the at least one expandable razor-sharp blade 26 from a stored position 44 to a deployed position 46. A pin 32 can support the at least one expandable blade 26 with respect to the shaft 14 allowing pivoting movement of the at least one blade 26 between a stored position 44 and a deployed position 46. A member 34 can engage the at least one expandable blade 26 for urging the at least one blade 26 from a stored position 44 toward a deployed position 46. A spring 36 can be provided for biasing the at least one expandable blade 26 from a stored position 44 toward a deployed position 46. A stop pin 38 can be supported relative to the shaft 14 for movement between a rearward position and a forward position. The shaft extension body 24 can include a stop slot 40 for controlling longitudinal movement of the shaft 14 between a rearward position and a forward position.

A device 10 can be provided for extending a shaft 14 of an arrow 42. A hollow arrow sleeve 28 can have a forward end 18 and a rearward end 20. The hollow arrow sleeve 28 can support at least one auxiliary, expandable, razor-sharp blade 26 for pivoting movement between a stored position 44 lying enclosed within the sleeve 28 and a deployed position 46 extending outwardly through a slot 30*a*, 30*b* formed in the sleeve 28. A member 34 can be provided acting against the at least one auxiliary, expandable, razor-sharp blade 26 for urging the blade 26 toward the deployed position 46. The hollow arrow sleeve 28 can be movable longitudinally toward the rearward end 20 for releasing the expandable, razor-sharp blade 26 from the stored position 44. A spring 36 can bias the member 34 against the at least one auxiliary, expandable, razor-sharp blade 26. A stop pin and slot combination 38, 40 can interact relative to the shaft 14 and sleeve 28 for controlling longitudinal movement of the shaft 14 between a rearward position and a forward position relative to the sleeve 28.

An arrow sleeve 28 can be manufactured from a carbon or aluminum shaft extension that can be placed at a broad head end 18, at the middle of an arrow, or before the nock end 20 of an arrow shaft 14. The arrow sleeve 28 or shaft extension body 24 can be used on any arrow shaft 14, or with any arrow broad head 16, making the arrow "weight forward" in the front. The "second cut" arrow sleeve 28 or shaft extension body 24 can be located behind the arrow broad head, arrow field head, mechanical arrow broad head, or any type of arrow broad head 16 that can strike through the deer on impact. The "second cut" arrow sleeve 28 or shaft extension body 24 can be activated by impact force against the game animal with a predetermined pounds per square inch pressure sufficient to automatically open or expand a second set of blades 26 from within the shaft extension body 24 or arrow sleeve 28, as reverse blades, to provide more cutting area after the first broad head 16 makes the hole.

The first broad head 16 can break through the hide and bone of a game animal, followed by the "second cut" expandable blades 26 in the arrow sleeve 28 which can expand to cut more vital areas inducing greater blood loss from the game animal to make a better blood trail. This will permit more impact, as well as kinetic energy when it impacts the game animal. The arrow sleeve 28 or shaft extension body 24 can be approximately a 3-4 inches long, a similar length can be removed or taken off from a carbon or aluminum arrow shaft. The arrow sleeve 28 or shaft extension body 24 can be screwed on to a shortened end of an existing old arrow shaft 14 or new arrow shaft 14, allowing the archer to attach an existing or new broad head 16 to connect to a front end 18 of the arrow sleeve 28 or shaft extension body 24. The advantages to this configuration and location of the arrow sleeve 28 or shaft extension body 24 is that essentially the weight would be located toward a forward end 18 of the arrow assembly, so after the arrow assembly hit a game animal the impact can open up the expandable blades 26 and gain enhanced kinetic energy.

When an arrow assembly hits a game animal, the arrow sleeve 28 or shaft extension body 24 is actuated by the impact to expand the blades 26 supported within the sleeve 28 providing an approximately one inch to three inch blade 26 on each side giving anywhere from 1½ inch to 3 inches more cut on an arrow assembly. The arrow sleeve 28 or shaft extension body 24 can be installed anywhere on the arrow 10 from a broad head end 18 to the middle area or a fletching rearward area 20, while allowing the arrow sleeve 28 or shaft extension body 24 to work in the same way. With this arrow sleeve 28 or shaft extension body 24, each hunter can still use the arrows of their choice, any type that is aluminum or carbon and can continue to use their choice of broad head 16. Therefore, each hunter can add the arrow sleeve 28 or shaft extension body 24 in addition to their normal choice of arrow shaft 14 and broad head 16 to provide a better hunting experience and higher likelihood of success. The arrow sleeve 28 or shaft extension body 24 is a second cut product that will penetrate and cut the game animal a second time during a single arrow assembly impact. The arrow sleeve 28 or shaft extension body 24 product will also work on regular bows, cross bows, or an old re-curve bow.

In summary, when an arrow assembly including a "second cut" arrow sleeve 28 or shaft extension body 24 hits a game animal, the forward end 18 of the arrow 14 and attached outer sleeve 28 slides backward slightly toward a rear end 20 of the arrow assembly, which internally aligns open slots 30*a*, 30*b* with the blades 26, allowing the blades 26 to expand and lock in an expanded position 46, such that the blades 26 are fixed and will not retract. The arrow sleeve 28 or shaft extension body 24 product is designed for a single, one-time use. The expandable blades 26 supported by the arrow sleeve 28 or shaft extension body 24 can be design to make a cut of up to five inches. If for some reason the arrow assembly including the arrow sleeve 28 or shaft extension body 24 gets dropped on accident, a hunter can push the expandable blades 26 back into place manually with ease.

The arrow assembly can include any broad head 16 capable of penetrating a game animal, the impact energy would put the second cut force back and mechanically would force two or three blades 26 out and lock in place with our design. The unit can be designed with a plastic inner portion and with titanium, or aluminum or carbon outer portions. The sleeve 28 or shaft extension body 24 can open with a simple slide and lock from the tread insert member 34 moving 1/16 of an inch or less and then pushes downward to the blade pin assembly. The blades 26 extract and are locked to prevent collapsing movement back into the corresponding deployment slot 30*a*, 30*b*.

The arrow sleeve 28 or shaft extension body 24 can be installed between an arrow shaft 14 and an arrow broad head 16. When the arrow sleeve 28 or shaft extension body 24 is in place, and a predetermined amount of pressure is put on the broad head 16, the broad head 16 depresses and an internal portion 24*a* of the shaft extension body 24 driven by the arrow shaft 14 of the assembly travels forward within a sleeve 28 to align slot openings 30*a*, 30*b* with the expandable blades 26 simultaneously compressing a spring 36 to force open the expandable blades 26 and locks the blades 26 in place with a scissor action. It should be recognized that the arrow sleeve 28 or shaft extension body 24 can be used anywhere along the arrow shaft 14, if desired.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a projectile defined by an elongated missile intended to be projected for movement through air by a bow, and having a shaft extending between a target-contacting head portion located at one end and feathering at an opposite end thereof, the improvement comprising:

a shaft extension body intended to be located between the target-contacting head portion and feathering of the shaft for supporting at least one auxiliary, expandable, razor-sharp blade adapted to cut a target;

an elongated hollow sleeve supported relative to the target-contacting head portion allowing longitudinal movement of the at least one auxiliary, expandable, razor-sharp blade between a rearward position and a forward position in response to the target-contacting head portion impacting the target, the sleeve having at least one slot allowing passage of the at least one auxiliary, expandable, razor-sharp blade from a stored position to a deployed position in response to movement of the at least one auxiliary, expandable, razor-sharp blade from the rearward position to the forward position relative to the sleeve;

a pin supporting the at least one auxiliary, expandable, razor-sharp blade with respect to the shaft allowing pivoting movement of the at least one auxiliary, expandable, razor-sharp blade between the stored position and the deployed position; and a member engaging the at least one auxiliary, expandable, razor-sharp blade for urging the at least one auxiliary, expandable, razor-sharp blade to pivot with respect to the pin toward the deployed position.

2. The improvement of claim 1, further comprising:

a spring for biasing the member toward the at least one auxiliary, expandable, razor-sharp blade.

3. The improvement of claim 2, further comprising:

a stop pin supported relative to the shaft.

4. The improvement of claim 3, further comprising:

the sleeve having a stop slot formed therein to receive the stop pin for controlling longitudinal movement of the shaft with respect to the sleeve in response to impact of the target-contacting head portion with the target.

5. A device for extending a shaft of an elongated arrow having a forward end and a rearward end comprising:

a shaft extension body intended to be located at any position along a length of the elongated arrow between the forward end and the rearward end inclusive for supporting at least one auxiliary, expandable, razor-sharp blade; and a member engaging the at least one auxiliary, expandable, razor-sharp blade for urging the at least one auxiliary, expandable, razor-sharp blade from a stored position toward a deployed position.

6. The device of claim 5, wherein the shaft extension body further comprises:

an elongated hollow sleeve supported relative to the forward end of the elongated arrow allowing longitudinal movement of the at least one auxiliary, expandable, razor-sharp blade between a rearward position and a forward position in response to the elongated arrow impacting a target.

7. The device of claim 5, wherein the shaft extension body includes at least one slot allowing passage of the at least one auxiliary, expandable, razor-sharp blade from a stored position to a deployed position.

8. The device of claim 5, wherein the shaft extension body further comprises:

a pin supporting the at least one auxiliary, expandable, razor-sharp blade with respect to the shaft allowing pivoting movement of the at least one auxiliary, expandable, razor-sharp blade between a stored position and a deployed position.

9. The device of claim 5, wherein the shaft extension body further comprises:

a spring for biasing the at least one auxiliary, expandable, razor-sharp blade from a stored position toward a deployed position.

10. The device of claim 5, wherein the shaft extension body further comprises:

a stop pin supported relative to the shaft for movement between a rearward position and a forward position.

11. The device of claim 5, wherein the shaft extension body includes a stop slot for controlling longitudinal movement of the shaft between the rearward position and the forward position.

12. A device for extending a shaft of an arrow comprising:

a hollow arrow sleeve having a forward end and a rearward end, the hollow arrow sleeve supporting at least one auxiliary, expandable, razor-sharp blade for pivoting movement between a stored position lying enclosed within the sleeve and a deployed position extending outwardly through a slot formed in the sleeve; and a member acting against the at least one auxiliary, expandable, razor-sharp blade for urging the at least one auxiliary, expandable, razor-sharp blade toward the deployed position.

13. The device of claim 12 further comprising:

the hollow arrow sleeve movable longitudinally toward the rearward end for releasing the at least one auxiliary, expandable, razor-sharp blade from the stored position.

14. The device of claim 12 further comprising:

a spring biasing the member against the at least one auxiliary, expandable, razor-sharp blade.

15. The device of claim 12 further comprising:

a stop pin and slot combination interacting relative to the shaft and sleeve for controlling longitudinal movement of the shaft between a rearward position and a forward position relative to the sleeve.

16. A method for assembling a shaft extension for an arrow comprising:

supporting at least one auxiliary, expandable, razor-sharp blade for pivoting movement between a stored position lying enclosed within the sleeve and a deployed position extending outwardly through a slot formed in the sleeve; and urging the at least one auxiliary, expandable, razor-sharp blade toward the deployed position with a member.

17. The method of claim 16 further comprising:

biasing the member against the at least one auxiliary, expandable, razor-sharp blade with a spring.

18. The method of claim 16 further comprising:

allowing longitudinal movement of the at least one auxiliary, expandable, razor-sharp blade between a rearward position and a forward position in response to a target-contacting head portion impacting a target.

19. The method of claim 16 further comprising:

allowing limited relative longitudinal movement between a hollow arrow sleeve having a forward end and a rearward end and an internal portion of a shaft extension body sheathed by the sleeve.

20. The method of claim 19 further comprising:

controlling longitudinal movement of the internal portion of the shaft extension body between a rearward position and a forward position relative to the sleeve with a stop pin and slot combination interacting relative to the internal portion of the shaft extension body and the sleeve.

* * * * *